US006921425B2

(12) United States Patent
Blejde et al.

(10) Patent No.: US 6,921,425 B2
(45) Date of Patent: Jul. 26, 2005

(54) MODEL-BASED SYSTEM FOR DETERMINING PROCESS PARAMETERS FOR THE LADLE REFINEMENT OF STEEL

(75) Inventors: Walter N. Blejde, Brownsburg, IN (US); Joel Sommer, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 10/886,720

(22) Filed: Jul. 8, 2004

(65) Prior Publication Data

US 2004/0244532 A1 Dec. 9, 2004

Related U.S. Application Data

(62) Division of application No. 10/077,006, filed on Feb. 15, 2002, now Pat. No. 6,808,550.

(51) Int. Cl.[7] ..... C21C 1/04

(52) U.S. Cl. ..... 75/382; 266/79; 266/99

(58) Field of Search ..... 75/382; 266/78, 266/79, 99

(56) References Cited

U.S. PATENT DOCUMENTS

| | | | | |
|---|---|---|---|---|
| 3,955,968 | A | 5/1976 | Wintrell | |
| 5,298,053 | A | 3/1994 | Griffing | |
| 5,366,539 | A | 11/1994 | Abele et al. | |
| 5,720,336 | A * | 2/1998 | Strezov | 164/480 |
| 5,884,685 | A * | 3/1999 | Umezawa et al. | 75/376 |
| 6,808,550 | B2 * | 10/2004 | Mahapatra et al. | 75/382 |
| 2004/0144518 | A1 * | 7/2004 | Blejde et al. | 164/480 |
| 2004/0144519 | A1 * | 7/2004 | Blejde et al. | 164/480 |
| 2004/0177944 | A1 * | 9/2004 | Blejde et al. | 164/480 |
| 2004/0177945 | A1 * | 9/2004 | Blejde et al. | 164/480 |

FOREIGN PATENT DOCUMENTS

| | | |
|---|---|---|
| DE | 29 00 047 | 7/1980 |
| EP | 0 589 435 | 3/1994 |
| EP | 0 665 295 | 8/1995 |
| EP | 1 091 005 | 4/2001 |
| GB | 1 486 423 | 9/1977 |
| GB | 2 085 926 | 5/1982 |
| JP | 58-009913 | 1/1983 |
| JP | 02-220735 | 9/1990 |
| JP | 06-207212 | 7/1994 |
| JP | 07-305110 | 11/1995 |
| JP | 09-031522 | 2/1997 |
| JP | 10-212514 | 8/1998 |
| JP | 11-061233 | 3/1999 |
| JP | 2000-160233 | 6/2000 |
| JP | 2000-214127 | 8/2000 |
| JP | 2000-234119 | 8/2000 |
| JP | 2001-164312 | 6/2001 |
| WO | WO 96/21046 | 7/1996 |
| WO | WO 02/14562 | 2/2002 |

* cited by examiner

*Primary Examiner*—Scott Kastler

(57) ABSTRACT

A system for determining process parameters for the ladle refinement of steel includes a computer executing a number of software algorithms for determining one or more process parameters for various steel refinement process steps. In one embodiment, for example, the computer is configured to determine the total amount of flux additions to achieve a desired sulfur percentage as part of a steel desulfurization process. In another embodiment, the computer is configured to determine the total quantity of oxygen to be injected into the steel as part of a steel reoxidation process. In still another embodiment, the computer is configured to determine a melting temperature of inclusions within the refined steel, and to determine whether this melting temperature is within an acceptable range to successfully process the steel in a continuous steel strip casting apparatus/process, or whether the steel must be reworked to achieve an acceptable inclusion melting temperature.

8 Claims, 6 Drawing Sheets

MODEL-BASED SYSTEM FOR DETERMINING PROCESS PARAMETERS FOR THE LADLE REFINEMENT OF STEEL

CROSS REFERENCE TO RELATED APPLICATIONS

This application is a division of U.S. patent application Ser. No. 10/077,006, filed Feb. 15, 2002. now U.S. Pat. No. 6,808,550.

FIELD OF THE INVENTION

The present invention relates generally to ladle refining of steel, and more specifically, although not exclusively, to processes for ladle refinement of steel to be directly cast into thin steel strip in a continuous strip caster.

BACKGROUND OF THE INVENTION

It is known to cast metal strip by continuous casting in a twin roll caster. In such a process, molten metal is introduced between a pair of contra-rotated horizontal casting rolls which are cooled so that metal shells solidify on the moving roll surfaces and are brought together at the nip between them to produce a solidified strip product which is delivered downwardly from the nip between the rolls. The molten metal may be introduced into the nip between the two rolls via a tundish and a metal delivery nozzle system located beneath the tundish so as to receive a flow of metal therefrom and to direct it into the nip between the rolls, so forming a casting pool of molten metal supported on the casting surfaces of the rolls immediately above the nip. This casting pool may be confined between side plates or dams held in engagement adjacent the ends of the rolls so as to dam the two ends of the casting pool against outflow, although alternative means such as electromagnetic barriers have also been proposed.

Twin roll casting has been applied with some success to non-ferrous metals which solidify rapidly on cooling, for example aluminum. However, there have been problems in applying the technique to the casting of ferrous metals. One particular problem has been the propensity for ferrous metals to produce solid inclusions which clog the very small metal flow passages required in a twin roll caster.

The use of silicon-manganese in ladle deoxidation of steel was practiced in ingot production in the early days of Bessemer steelmaking. As a result, the equilibrium relations between the reaction product molten manganese silicates and the residual manganese, silicon and oxygen in solution in steel are well known. However in the development of technology for the production of steel strip by slab casting and subsequent cold rolling, silicon/manganese deoxidation has generally been avoided and it has been generally considered necessary to employ aluminum killed steels. In the production of steel strip by slab casting and subsequent hot rolling followed often by cold rolling, silicon/manganese killed steels produce an unacceptably high incidence of stringers and other defects resulting from a concentration of inclusions in a central layer of the strip product.

In the continuous casting of steel strip in a twin roll caster, it is critically important to generate a finely controlled flow of steel at constant velocity along the length of the casting rolls to achieve sufficiently rapid and even cooling of steel over the casting surfaces of the rolls. This requires that the molten steel be constrained to flow through very small flow passages in refractory materials in the metal delivery system under conditions in which there is a tendency for solid inclusions to separate out and clog those small flow passages.

After an extensive program of strip casting various grades of steel in a continuous strip roll caster, it has been determined that conventional aluminum killed carbon steels or partially killed steel with an aluminum residual content of 0.01%, or greater, generally cannot be cast satisfactorily because solid inclusions agglomerate and clog the fine flow passages in the metal delivery system to form defects and discontinuities in the resulting strip product. This problem can be addressed by calcium treatment of the steel to reduce the solid inclusions, but this is expensive and needs fine control adding to the complexity of the process and equipment. On the other hand, it has been found that it is possible to cast strip product without stringers and other defects normally associated with silicon/manganese killed steels because the rapid solidification achieved in a twin roll caster avoids the generation of large inclusions and the twin roll casting process results in the inclusions being evenly distributed throughout the strip rather than being concentrated in a central layer. Moreover, in thin strip casting, it is possible to adjust the silicon and manganese contents so as to produce liquid deoxidation products at the casting temperature to minimize agglomeration and clogging problems.

In conventional silicon/manganese deoxidation processes, it has not been possible to lower free oxygen levels in the molten steel to the same extent as is achievable with aluminum deoxidation, and this problem in turn has inhibited desulfurization. For continuous strip casting, it is desirable to have a sulfur content of the order of 0.009% or lower. In conventional silicon/manganese deoxidation processes in the ladle, the desulfurization reaction is very slow, generally more than an hour, and it becomes impractical to achieve desulfurization to such low levels particularly in the case where the steel is produced by the EAF route using commercial quality scrap. Such scrap may typically have a sulfur content in the range 0.025% to 0.045% by weight. Details relating to strategies for enabling effective and efficient deoxidation and desulfurization of silicon/manganese killed steel, and for refining of high sulfur silicon/manganese killed steel to produce low sulfur steel which has free oxygen levels suitable for continuous thin strip casting, are disclosed in co-pending U.S. patent application Ser. No. 60/280,916, which is assigned to the assignee of the present invention, and the disclosure of which is expressly incorporated herein by reference.

When casting thin steel strip in a twin roll caster the molten steel in the casting pool will generally be at a temperature of the order of 1500° C. and above, and it is therefore necessary to achieve very high cooling rates over the casting surfaces of the rolls. It is particularly important to achieve high heat transfer and extensive nucleation on initial solidification of the steel on the casting surfaces to form the metal shells. U.S. Pat. No. 5,720,336 describes how the heat flux on initial solidification can be increased by adjusting the steel melt chemistry such that a substantial proportion of the metal oxides formed as deoxidation products are liquid at the initial solidification temperature so as to form a substantially liquid layer at the interface between the molten metal and each casting surface. It has been determined that nucleation is also dependent on the presence of oxide inclusions in the steel melt and that surprisingly it is not advantageous in twin roll strip casting to cast with "clean" steel in which the number of inclusions formed during deoxidation has been minimized.

Steel for continuous casting is subjected to deoxidation treatment in the ladle prior to casting as described hereinabove. In twin roll casting the steel is generally subjected to silicon manganese ladle deoxidation although it is possible to use aluminum deoxidation with calcium addition to control the formation of solid $Al_2O_3$ inclusions that can clog the fine metal flow passages in the metal delivery system through which molten metal is delivered to the casting pool. It has been determined that while lowering the steel oxygen level of unrefined molten steel allows for subsequent desulfurization thereof as described hereinabove, it undesirably reduces the volume of oxide inclusions. If the total oxygen content of the steel is reduced below a certain level, the nature of the initial contact between the steel and roll surfaces can be adversely effected to the extent that there is insufficient nucleation to generate rapid initial solidification and high heat flux. Following desulfurization, free oxygen is therefore injected into the molten steel to raise its free oxygen content to a level that promotes sufficient nucleation to generate rapid initial solidification of the molten steel onto the casting rolls and production of a satisfactory strip product. As a result of the reoxidation of the molten steel, it then contains a distribution of oxide inclusions (typically MnO, CaO, $SiO_2$ and/or $Al_2O_3$) sufficient to provide an adequate density of nucleation sites on the roll surfaces for initial solidification and the resulting strip product exhibits a characteristic distribution of solidified inclusions. Details relating to one strategy for injecting oxygen into a ladle of steel prior to casting thereof are set forth in co-pending U.S. patent application Ser. No. 60/322,261, which is assigned to the assignee of the present invention, and the disclosure of which is incorporated herein by reference.

While the above-referenced patent applications disclose systems and strategies for carrying out deoxidation, desulfurization and reoxidation steps in the ladle refinement of steel prior to casting into steel strips, these processes tend to require tedious techniques for determining the process parameters required to achieve the refined steel. For example, to reduce the percentage of sulfur in the molten steel to a desired percentage, a controllable quantity of flux must be added thereto. As another example, the melting point of inclusions in the reined molten steel must be below a threshold temperature to ensure that a substantially liquid oxide layer exists at the interface between the molten metal and each casting roll surface. The total amount of free oxygen added in the reoxidation step, as well as the amount and composition of flux and/or alloy additions, must therefore be known and controlled to provide for a desired inclusion melting temperature in the batch or ladle of refined steel. Finally, it is necessary from a castability standpoint to determine the inclusion melting temperature of the batch of refined steel to determine whether the ladle may be routed to the strip casting process or whether it requires re-working in order to adjust the inclusion melting temperature. What is therefore needed is a strategy for determining these various process parameters for the ladle refinement of steel, wherein such strategy is straightforward in its application, easily implemented in software, and readily adaptable to a continuous steel strip casting process.

SUMMARY OF THE INVENTION

The foregoing shortcomings of the prior art are addressed by the present invention. In accordance with one aspect of the present invention, a process is provided comprising the steps of providing a ladle of molten steel having a predefined percentage of sulfur therein, deoxidizing said molten steel within said ladle, desulfurizing said molten steel within said ladle after said deoxidizing step, reoxidizing said molten steel within said ladle after said desulfurizing step, determining a melting point of inclusions comprising said molten steel within said ladle after said reoxidizing step, and routing said molten steel within said ladle to the steel strip casting process if said melting point is below a certain threshold melting point.

In accordance with still another aspect of the present invention, a method is provided comprising the steps of determining initial flux and alloy quantities comprising said batch of molten steel, determining quantity and composition of slag carryover within said batch of molten steel, determining quantity of alloy added to said batch of molten steel, measuring weight of said batch of molten steel, measuring temperature of said batch of molten steel, measuring free oxygen content of said batch of molten steel, and computing a quantity of flux to be added to said batch of molten steel to reduce said initial sulfur content to said desired sulfur content, said quantity of flux a function of said initial flux and alloy quantities, said quantity and composition of slag carryover, said quantity of alloy added to said batch of molten steel, and said weight, temperature and free oxygen content of said batch of molten steel.

In accordance with a further aspect of the present invention, a system is provided comprising means for determining initial flux and alloy quantities comprising said batch of molten steel, means for determining a weight value indicative of weight of said batch of molten steel, a temperature sensor producing a temperature value indicative of temperature of said batch of molten steel, an oxygen sensor producing an oxygen value indicative of free oxygen content of said batch of molten steel, and a computer configured to determine a quantity of flux to be added to said batch of molten steel to reduce said initial sulfur content to said desired sulfur content, said quantity of flux a function of said initial flux and alloy quantities, a quantity and composition of slag carryover, a quantity of alloy added to said batch of molten steel, said weight value, temperature value and said oxygen value.

In accordance with yet a further aspect of the present invention, a method is provided comprising the steps of determining inclusion composition and total steel oxygen content within said batch of molten steel, measuring weight of said batch of molten steel, measuring said initial free oxygen content of said batch of molten steel, determining said desired free oxygen content of said batch of molten steel, and computing a quantity of oxygen to be added to said batch of molten steel to increase said initial free oxygen content thereof to said desired free oxygen content, said quantity of oxygen a function of said inclusion composition, said total steel oxygen content, and said weight, said initial free oxygen content and said desired free oxygen content of said batch of molten steel.

In accordance with still a further aspect of the present invention, a system is provided comprising means for determining inclusion composition within said batch of molten steel, means for determining total steel oxygen content of said batch of molten steel, means for determining a weight value indicative of weight of said batch of molten steel, an oxygen sensor producing an oxygen value indicative of said initial free oxygen content of said batch of molten steel, and a computer configured to determine a quantity of oxygen to be added to said batch of molten steel to increase said initial free oxygen content thereof to said desired free oxygen content, said quantity of oxygen a function of said inclusion composition, said total steel oxygen content, said weight value, said oxygen value and said desired free oxygen content.

The present invention provides a process for ladle refinement of steel wherein the melting temperature of inclusions within the ladle of molten steel is computed to determine whether to route the molten steel to a downstream steel casting process or to rework the steel in order to improve the inclusion melting point.

The present invention also provides a system and method for computing an amount of flux to be added to the ladle of molten steel after deoxidation thereof to reduce its sulfur content to a desired sulfur content.

In accordance with another aspect of the present invention, a method is provided comprising the steps of determining inclusion composition of said batch of molten steel, measuring temperature of said batch of molten steel, measuring free oxygen content of said batch of molten steel, and computing melting temperature of inclusions within said batch of steel as a function of said inclusion composition, said temperature and said free oxygen content.

In accordance with yet another aspect of the present invention, a system is provided comprising means for determining inclusion composition of said batch of molten steel, a temperature sensor producing a temperature value indicative of temperature of said batch of molten steel, an oxygen sensor producing an oxygen value indicative of free oxygen content of said batch of molten steel, and a computer configured to determine melting temperature of inclusions within said batch of steel as a function of said inclusion composition, said temperature value and said oxygen value.

The present invention further provides a system and method for computing an amount of oxygen to be injected into the ladle of molten steel after the desulfurization thereof to raise its oxygen content to a desired oxygen content.

These and other objects of the present invention will become more apparent from the following description of the preferred embodiment.

DESCRIPTION OF THE PREFERRED EMBODIMENTS

Figure 1:
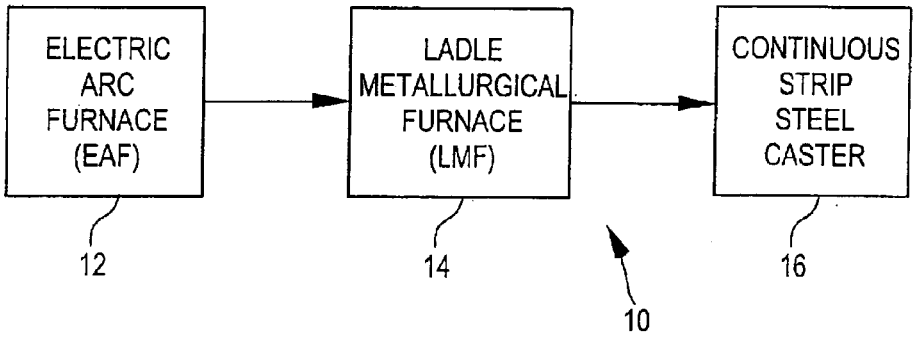
FIG. 1 is a diagrammatic illustration of one embodiment of a steel fabrication, refinement and casting process.

For the purposes of promoting an understanding of the operation of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, one embodiment of a steel production, refinement and casting process 10, in accordance with the concepts of the present invention, is shown. Process 10 includes an electric arc furnace 12 (EAF) in which unrefined molten steel is produced. From the EAF 12, the unrefined molten steel is routed to a ladle metallurgical furnace 14 (LMF) wherein the molten steel is refined to form a molten composition suitable for casting into thin steel strips. Ladles of molten steel suitable for casting are then routed from LMF 14 to a continuous strip steel caster apparatus/process 16 wherein the refined molten steel is cast into continuous thin steel strips. In one embodiment, apparatus/process 16 is embodied as a continuous strip caster in the form of a twin roll caster. In general terms, casting steel strip continuously in such a twin roll caster involves introducing the refined molten steel from LMF 14 between a pair of contra-rotated horizontal casting rolls which are internally water-cooled so that metal shells solidify on the moving roll surfaces and are brought together at the nip between them to produce a solidified cast strip delivered downwardly from the nip between the rolls, the term "nip" being used to refer to the general region at which the rolls are closest together. The molten metal may be poured from a ladle supplied by LMF 14 into a smaller vessel from which it flows through a metal delivery nozzle system located above the nip so as to direct it into the nip between the rolls, forming a casting pool of molten metal supported on the casting surfaces of the rolls immediately above the nip and extending along the length of the nip. This casting pool is typically confined between side plates or dams held in engagement adjacent the ends of the rolls so as to dam the two ends of the casting pool against outflow, although alternative means such as electromagnetic barriers have also been proposed. The casting of steel strip and twin roll casters of the type just described is further detailed in U.S. Pat. Nos. 5,184,668, 5,277,243 and 5,934,359, all of which are expressly incorporated herein by reference. Additional details relating to continuous steel strip casting of this type are described in co-pending U.S. patent application Ser. Nos. 09/967,163, 09/968,424, 09/966,184, 09/967,105 and 09/967,166 respectfully, all of which are assigned to the assignee of the present invention and the disclosures of which are each expressly incorporated herein by reference.

Figure 2:
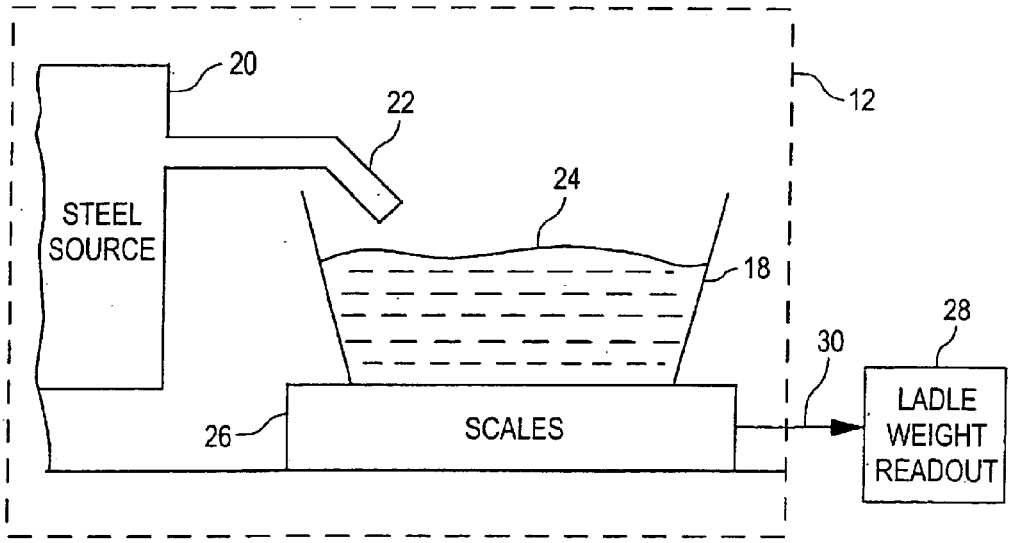
FIG. 2 is a diagrammatic illustration of some of the known elements and processes associated with the electric arc furnace illustrated in FIG. 1.

Referring now to FIG. 2, some of the elements and processes associated with the EAF 12 of FIG. 1 are illustrated. For example, a ladle 18 receives a quantity of molten steel 24 from steel source 20 via tap 22. Steel source 20 contains a supply of unrefined steel, the production of which does not form part of the present invention. In any case, the molten steel 24 within ladle 18 is weighed via scales 26, wherein scales 26 are electrically connected to a ladle weight readout monitor 28 via signal path 30. In operation, an operator may determine the weight of the molten steel 24 within ladle 18 via ladle weight readout monitor 28, and by taking into account the weight of ladle 18 itself.

Figure 3:
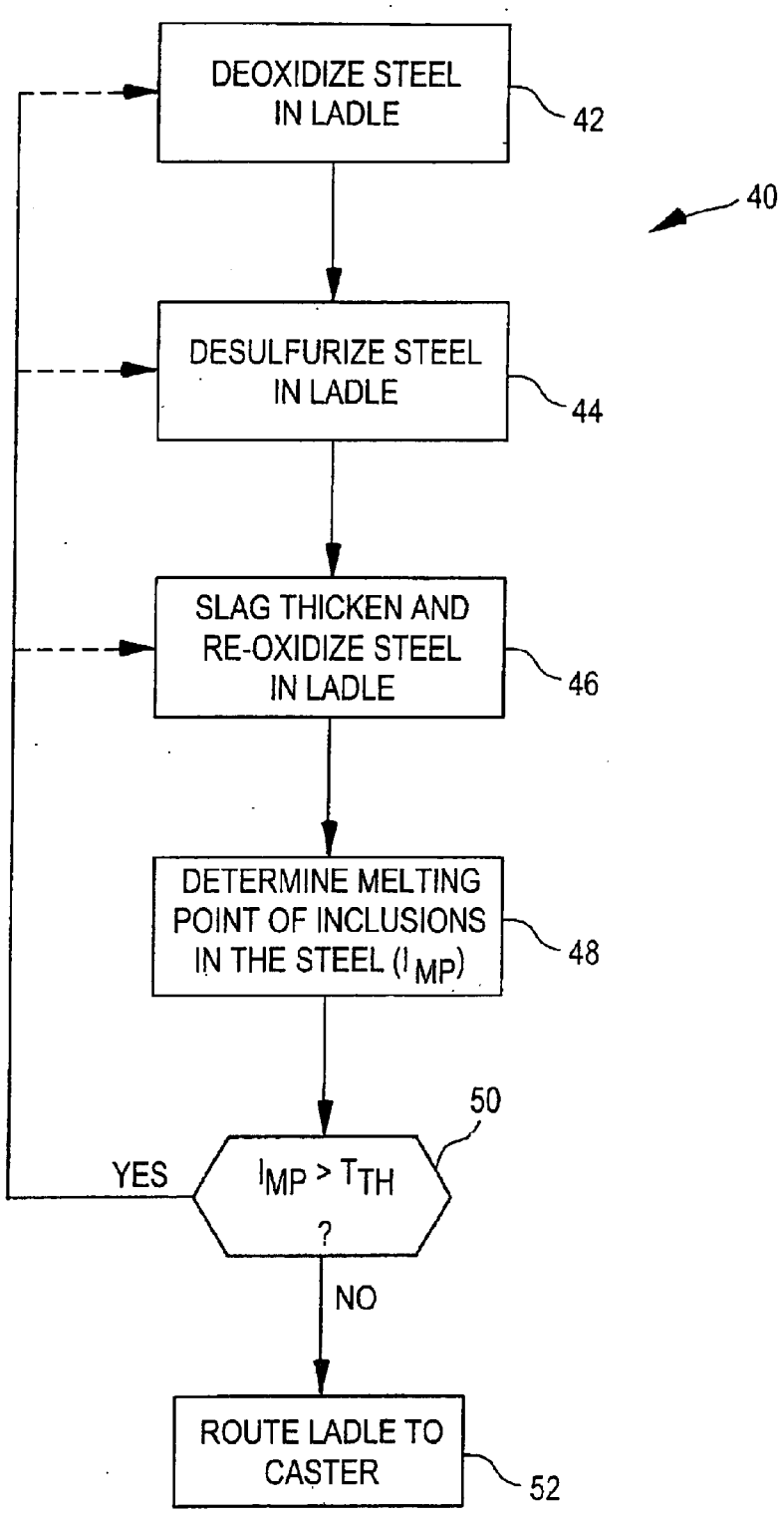
FIG. 3 is a process flow diagram illustrating one preferred embodiment of a process for refining steel within the ladle metallurgical furnace (LMF) illustrated in FIG. 1.

Referring now to FIG. 3, a process flow diagram is shown illustrating one preferred embodiment of a process 40 for refining the ladle 18 of unrefined molten steel 24 typically within the LMF 14. The ladle 18 of unrefined molten steel 24 is routed from the EAF 12 to the LMF 14 where process 40 is carried out to refine the molten steel 24 into a form suitable for casting by the continuous strip steel caster apparatus/process 16. Process 40 begins at step 42 where the molten steel 24 within the ladle 18 is deoxidized. In twin roll casting, the steel is generally subjected to the silicon manganese ladle deoxidization although it is possible to use aluminum deoxidization with calcium addition to control the formation of solid $AL_2O_3$ inclusions that can clog the fine metal flow passages in the metal delivery system through which metal is delivered to the casting pool of the continuous strip steel caster apparatus/process 16. Following the steel deoxidation process 42, process 40 advances to step 44 where the deoxidized molten steel 24 within ladle 18 is desulfurized. For continuous strip casting, it is desirable to have a sulfur content of the order of 0.009% or lower, although the present invention contemplates use of other sulfur percentage content. Following the desulfuriziation step 44, process 40 advances to step 46 where the deoxidized and desulfurized molten steel 24 within ladle 18 is slag thickened and reoxidized in preparation for the continuous steel strip casting apparatus/process 16. Further details relating to process steps 42, 44 and 46 are described in co-pending U.S. patent application Ser. No. 60/280,916 and U.S. patent application Ser. No. 60/322,261, both of which have been expressly incorporated herein by reference.

Following step 46, process 40 advances to step 48 where the melting point of inclusions ($I_{mp}$) within the molten steel 24 is determined. One preferred embodiment of a system for determining inclusion melting point ($I_{MP}$) will be described in greater detail hereinafter with respect to FIGS. 5 and 8. Following step 48, process 40 advances to step 50 where the inclusion melting point ($I_{MP}$) is compared with a temperature threshold ($T_{TH}$). When casting thin steel strip on a twin roll caster, the molten steel in the casting pool will generally be at a temperature of the order of 1500° C. and above, and it is therefore necessary to achieve very high cooling rates over the casting surfaces of the rolls. It is particularly important to achieve a high heat transfer rate and extensive nucleation of initial solidification of the steel on the casting surface to form the metal shells. U.S. Pat. No. 5,720,336, the disclosure of which is expressly incorporated herein by reference, describes how the heat transfer rate (i.e. heat flux) on initial solidification can be increased by adjusting the steel melt chemistry such that a substantial portion of the metal oxides resulting from the inclusion products are liquid at the initial solidification temperature so as to form a substantially liquid layer at the interface between the molten metal and each casting surface. It is therefore important in the continuous steel strip casting apparatus/process 16 for the inclusion melting point ($I_{MP}$) to be in an appropriate temperature range to provide for the substantially liquid oxide layer at the interface between the molten metal and each casting surface of the twin casting rolls in apparatus/process 16. Step 50 of process 40 accordingly compares the inclusion melting point ($I_{MP}$) to a critical temperature threshold ($T_{TH}$), wherein $T_{TH}$ is a temperature above which formation of the substantially liquid oxide layer at the interface between the molten metal and the casting roll surfaces cannot be insured. In one embodiment, $T_{TH}$ is set at approximately 1600° C., although the present invention contemplates other temperature threshold values. In any case, if $I_{MP}$ is greater than $T_{TH}$, process 40 loops back to any of steps 42, 44 and 46 for re-working of the molten steel 24 in order to produce an inclusion melting point ($I_{MP}$) within the desired temperature range. If, at step 50, $I_{MP}$ less than or equal to $T_{TH}$, then $I_{MP}$ is within the desired temperature range and the ladle 18 of appropriately refined molten steel 24 is routed to the continuous steel strip casting apparatus/process 16 at step 52.

Figure 4:
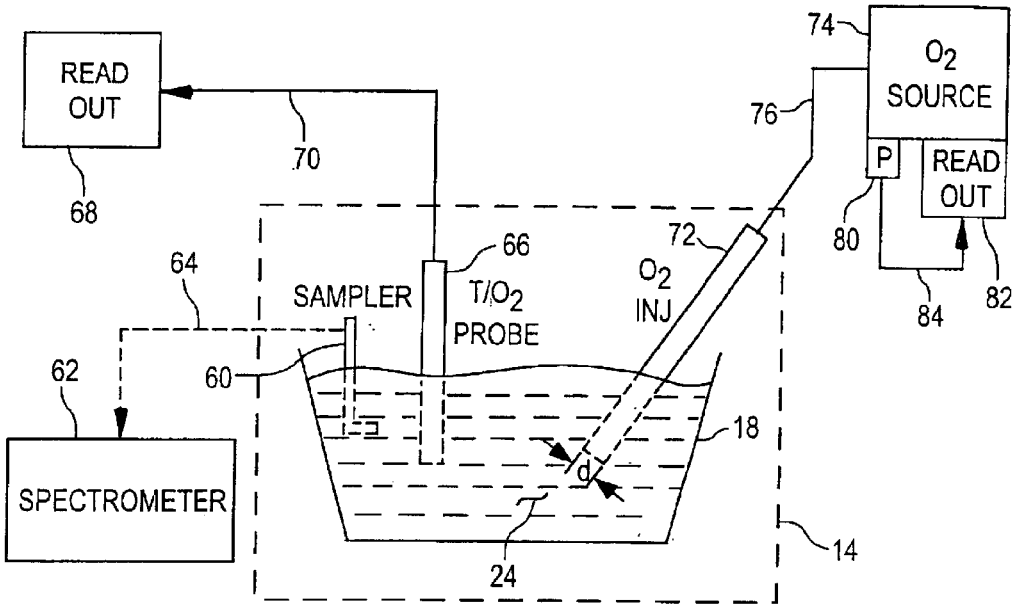
FIG. 4 is a diagrammatic illustration of one preferred embodiment of some of the elements and processes associated with the LMF illustrated in FIG. 1.

Referring now to FIG. 4, one preferred embodiment of some of the elements and processes associated with the LMF 14 of FIG. 1 are shown. For example, a sampling mechanism 60 is adapted to extract a sample of the molten steel 24 within ladle 18, wherein the sample is routed to a spectrometer 62 as shown by dashed-line path 64. Spectrometer 62 maybe of known construction and operable to determine the chemical composition of the sample of molten steel 24 in a manner well-known in the art. A temperature/oxygen probe 66 is shown immersed within the molten steel 24 and is electrically connected to a readout unit 68 via signal path 70. In one embodiment, probe 66 is a Celox® oxygen/temperature immersion probe of known construction and operable to provide information relating to both the temperature of the molten steel 24 as well as the oxygen content thereof. The Celox® oxygen measurement system measures the free oxygen in the molten steel and is described in "On-Line Oxygen Measurements During Liquid Steel Processing Using Novel Electrochemical Sensors" by K. Carlier, Heraeus Electro-Nite International N.V., Centrum-Zuid 1105, 3530 Houthalen, Begium (available from author). See also U.S. Pat. Nos. 4,342,633 and 4,964,736. The free oxygen is oxygen dissolved in the steel that is not combined with other elements in forming oxides.

The steel refinement process 40 of FIG. 3 requires reoxidation of the molten steel 24 within ladle 18 (step 46), and in this regard an oxygen injection lance 72 is shown in FIG. 4 as being immersed into the molten steel 24. Lance 72 is fluidly connected at one end to an oxygen source 74 via conduit 76 and defines an oxygen outlet port at an opposite end thereof having diameter "d". A pressure sensor 80 is disposed in fluid communication with oxygen source 74, and is electrically connected to a readout unit 82 via signal path 84. In operation, sensor 80 is operable to sense the pressure of oxygen within source 74, which corresponds to the pressure of oxygen being injected into the molten steel 24 via lance 72, and to display this oxygen injection pressure at readout unit 82. In any case, the total amount of oxygen injected into the molten steel 24 is generally a function of the oxygen injection pressure, the outlet diameter "d" of the lance 72, and other factors as will be described in greater detail hereinafter with respect to FIG. 7.

Figure 5:
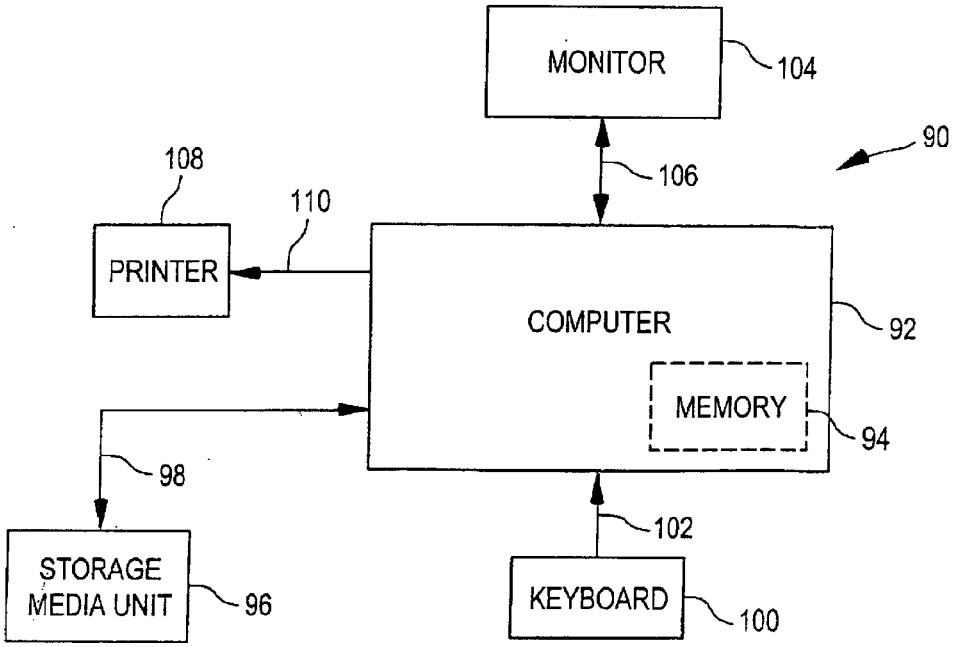
FIG. 5 is a diagrammatic illustration of a general purpose computer system operable to determine process parameters for the refinement of steel within the LMF of FIGS. 1 and 4.

Referring now to FIG. 5, one preferred embodiment of a system 90 for determining a number of process parameters for carrying out the steel refinement process 40 illustrated in FIG. 3 is shown. Central to system 90 is a general-purpose computer 92 that may be a conventional desktop personal computer (PC), laptop or notebook computer, or other known general-purpose computer configured to operate in a manner to be described subsequently. Computer 92 includes a conventional memory 94 for storing information and executable software algorithms therein as is known in the art. A keyboard 100 is electrically connected to computer 92 via signal path 102, and may be used to enter certain information relating to the steel refinement process 40 as will be described in greater detail with respect to FIGS. 6–8. Computer 92 is also connected to a storage media unit 96 via signal path 98, wherein storage unit 96 maybe any conventional storage media unit such as a floppy disk drive, hard drive, CD-Rom unit, or the like. A monitor 104 is electrically connected to computer 92 via signal path 106, and is provided for displaying information relating to the steel refining process 40 illustrated in FIG. 3. Additionally or alternatively, a printer 108 is electrically connected to computer 92 via signal path 110, wherein printer 108 maybe used to provide hard copy documentation of one or more aspects of the steel refining process 40.

Figure 6:
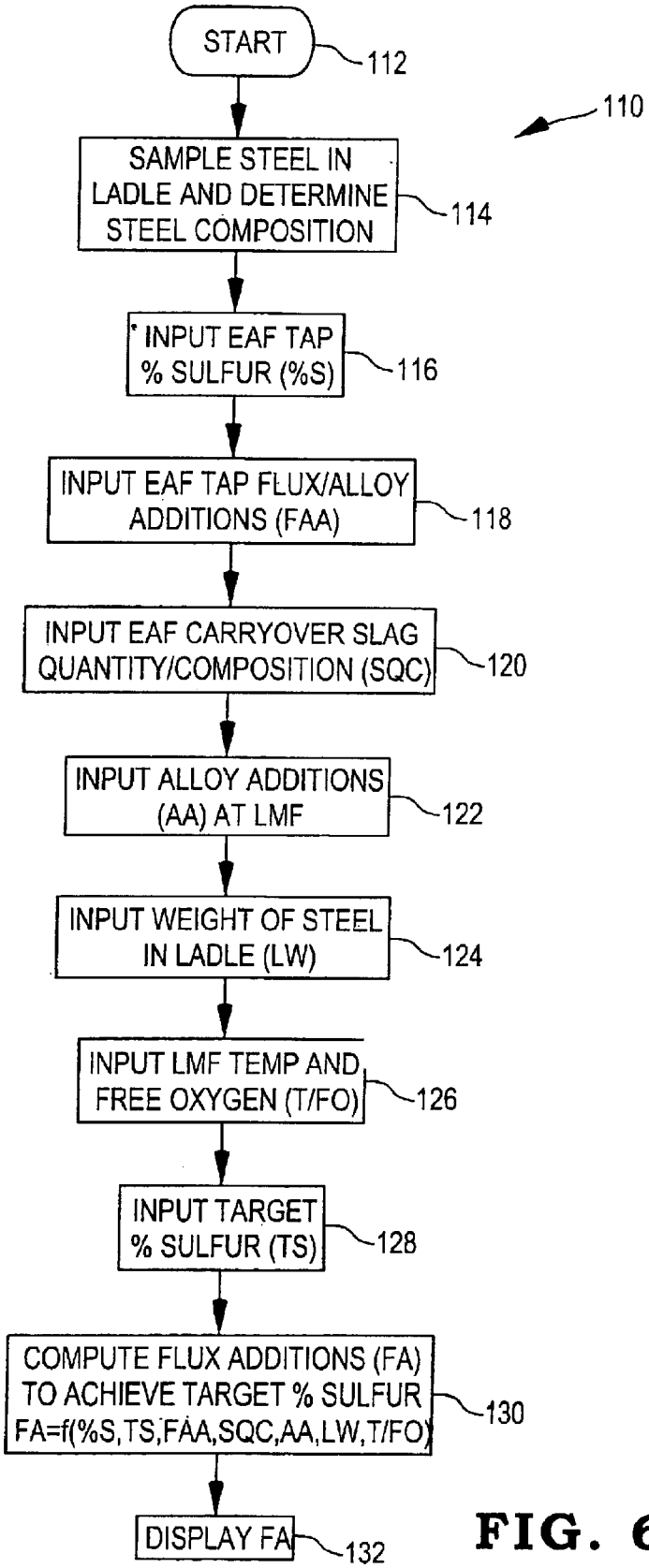
FIG. 6 is a flowchart illustrating one preferred embodiment of a software algorithm for computing at least one process parameter associated with the desulfuization process illustrated in FIG. 3.

Referring now to FIG. 6, a flowchart is shown illustrating one preferred embodiment of a software algorithm 110 for computing at least one process parameter associated with the desulfurization step 44 of process 40 (FIG. 3). Algorithm 110 may be stored within memory 94 of computer 92, and is executed by computer 92 to compute the at least one process parameter associated with the desulfurization step 44. Algorithm 110 begins at step 112, and at step 114, a sample of the molten steel 24 within ladle 18 is taken via sampler 60 and analyzed within the spectrometer 62 to determine its chemical composition. This analysis is carried out after the transfer of ladle 18 from the EAF 12 to the LMF 14, but before any refining of the molten steel 24 within the LMF 14. Accordingly, analysis of the steel sample via spectrometer 62 will provide information relating to the sulfur content of the molten steel 24 supplied by the EAF 12. This information, in terms of sulfur percentage (% S) is input to computer 92 via any conventional means, such as via keyboard 100, at step 116.

In the production of the molten steel 24 within the EAF 12, certain flux and/or alloy additions may have been made thereto. The composition and quantity of such flux and/or alloy additions will generally be known from the production of the unrefined steel at the EAF 12. At step 118, this information relating to the quantity and composition of such flux and/or alloy additions (FAA) is entered into computer 92 via keyboard 100 or other input mechanism. In addition, the spectrometer analysis carried out at step 114 will typically provide information relating to the flux and/or alloy composition of the molten steel 24, and information available as a result of step 114 may be used to determine the amount of flux and/or alloy additions (FAA) to be input to computer 92 at step 118. From the alloy composition, the flux composition is known given standard fluxing practices for the steel regime and related empirical equations, which are established beforehand by experiments and empirical analysis.

In the typical operation of EAF 12, slag may typically be added to the ladle 18 and therefore become part of the molten steel 24. The quantity and composition of such slag (SQC) is generally determined via experience with, and knowledge of, the steel strip casting apparatus/process 16, and those skilled in the art will recognize that such slag composition and amount may vary from process to process. In one embodiment, a default slag quantity/composition (SQC) is stored in memory 94, and is displayed on monitor 104 prior to execution of step 120. In this embodiment, the operator may simply choose to enter this default SQC information, or may instead override the default SQC information and manually enter the desired SQC information, via keyboard 100 or other input mechanism. Alternatively, algorithm 110 may be configured such that no default SQC information is stored in memory and at step 120, the quantity and composition of such slag (SQC) is input to computer 92 via keyboard 100 or other input mechanism. As with the flux and/or alloy additions the EAF carryover slag quantity and composition maybe known as just described.

Algorithm 110 advances from step 120 to step 122 where the amount of alloy additions (AA) made at the LMF 14 as a result of the deoxidization step 42 of process 40 are entered into computer 92 via keyboard 100 or other input mechanism. Thereafter at step 124, the weight of the molten steel 24 within ladle 18 (LW) is input into computer 92 via computer keyboard 100 or other input mechanism. The weight of the molten steel 24 within ladle 18 was determined at the EAF 12 prior to any alloy additions made at the LMF 14 as described hereinabove with respect to FIG. 3. The weight LW entered into computer 92 at step 124 is thus the weight of the molten steel 24 determined at the EAF 12 adjusted by the weight of any alloy or any other additions made at the LMF 14.

Thereafter at step 126, the temperature of the molten steel 24 and its free oxygen content (T/FO) at the LMF 14 is entered into computer 92 via keyboard 100 or other input mechanism. The temperature and free oxygen values are provided by the temperate/oxygen probe 66 depicted in FIG. 4, wherein such information is displayed on readout 68. Following step 126, algorithm 110 advances to step 128 where the desired sulfur percentage (TS) is entered into computer 92 via keyboard 100 or other input mechanism. As described briefly hereinabove, it is desirable in continuous strip steel casting to have a sulfur content on the order of 0.009% or lower, and the desired sulfur percentage TS entered at step 128 may therefore be typically be 0.009% or lower. In any case, step 128 of algorithm 110 advances to step 130 where computer 92 is operable to compute the amount of flux additions (FA) required to achieve the desired sulfur percentage TS, where FA is a generally function of % S, TS, FAA, SQC, AA, LW and T/FO.

The computations steps performed by computer 92 using algorithm 110 are illustrated as follows. First, the amounts of the oxides of slag composition are estimated from the flux additions at the EAF tap and the alloy additions at the LMF at equations known to those skilled in the art, i.e., $SiO_2$, $Al_2O_3$, $TiO_2$, CaO, $CaF_2$, MgO, FeO and MnO. Second, the optical basicity of the slag is computed for the projected oxides of the slag compositions using equations such those described in "the Composition and Temperature Dependence of the Sulfide Capacity of Metallurgical Slags" by D. J. Sosinsky and I. D. Sommerville, Metallurgial Transactions, Volume 17B (June 1986) at pages 331–337. For example:

$$\Lambda = X_A\Lambda_A + X_B\Lambda_B + X_C\Lambda_C + \ldots \quad (1)$$

where:

$\Lambda$=optical basicity of the slag.

$X_A, X_B, X_C, \ldots$ are the mole fractions of oxide computed from the first step.

$\Lambda_A, \Lambda_B, \Lambda_C \ldots$ are the optical basicity of the individual oxides obtained from the published paper.

Third, the sulfide capacity of the slag ($C_s$) can then be computed using the following equation:

$$\text{Log}\, C_s = \left(\frac{22690 - 54640\Lambda}{T} + \right) 43.6\Lambda - 25.2 \quad (2)$$

where:

$C_s$=Sulfide capacity of the slag.

T=temperature of the slag (which is also the temperature of the steel).

Fourth, the partition ratio ($L_s$) of the percent sulfur in the slag and in turn the percent sulfur in the steel is computed using the following equation:

$$\text{Log}\, L_s = \frac{-770}{T} + 1.30 + \log C_s - \log a_0 \quad (3)$$

where:

$$L_s = \%\, S_{slag} \div \%\, S_{steel}$$

$a_0$=activity of oxygen obtained from the free oxygen.

Fifth, the computed percent sulfur in the steel can then be compared with the target setpoint percent sulfur in the steel. If the calculated percent sulfur in the steel is greater than the target setpoint of percent sulfur in the steel, than flux such as lime, CaO or MgO to be added to the steel is added in the computation, and addition of flux iteratively performed until the calculated percent sulfur is at the level of percent sulfur of the target setpoint. These relationships are generally known in the art, and it is therefore understood that other equations could be used for algorithm 110 to make this iternative computation.

Returning again to FIG. 6, algorithm 110 advances from step 130 to step 132 where computer 92 is operable to display the flux additions quantity (FA) on the monitor 104 to achieve the percent sulfur target set point. An operator may then add the displayed amount of flux to the ladle 18 of molten steel 24 to reduce the sulfur content thereof to the desired sulfur percentage.

Figure 7:
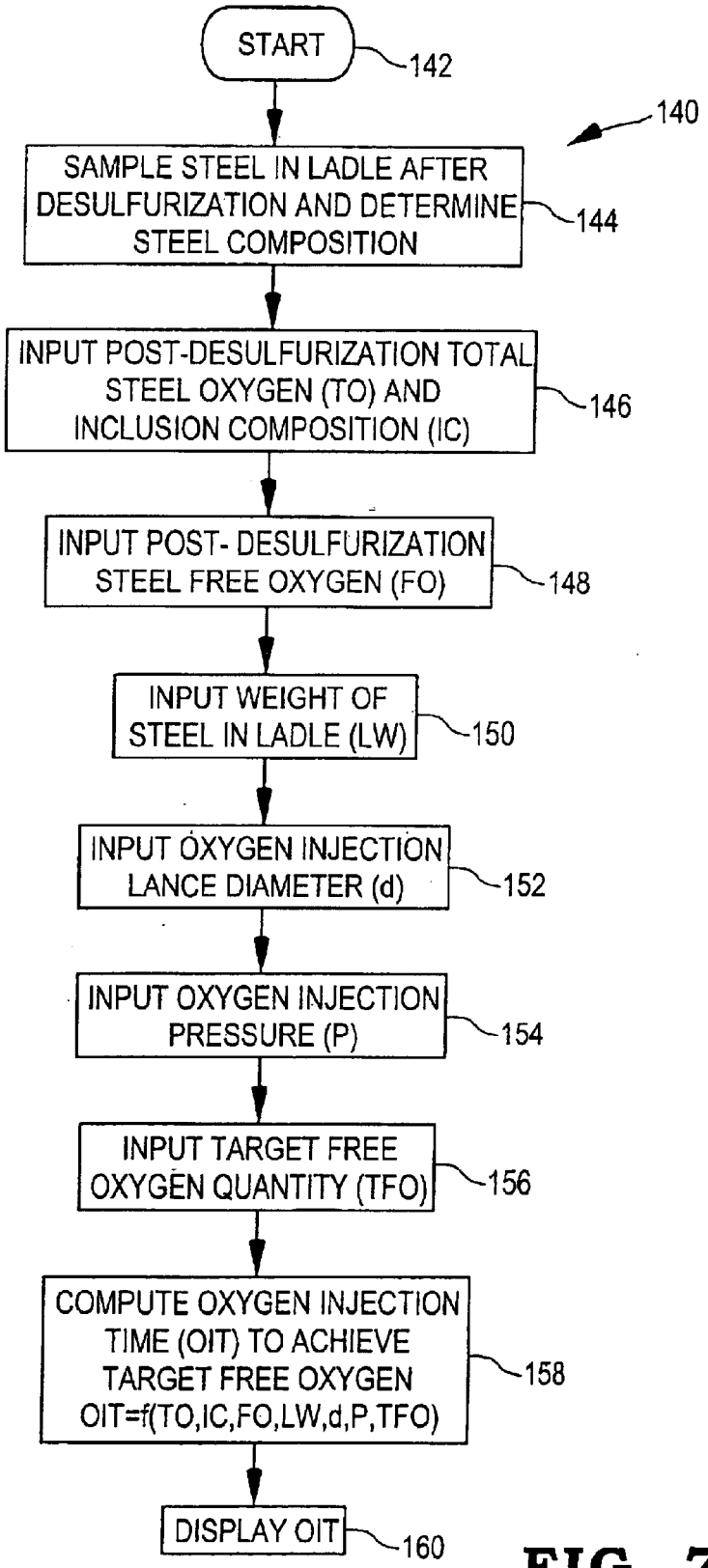
FIG. 7 is a flowchart illustrating one preferred embodiment of a software algorithm for computing at least one process parameter associated with the reoxidation process illustrated in FIG. 3.

Referring now to FIG. 7, a flowchart is shown illustrating one preferred embodiment of a software algorithm 140 for computing at least one process parameter associated with the reoxidation step 46 of process 40 (FIG. 3). Algorithm 140 may be stored within memory 94 of computer 92, and is executed by computer 92 to compute the at least one process parameter associated with the reoxidation step 46. Algorithm 140 begins at step 142, and at step 144, a sample of the molten steel 24 within ladle 18 is taken via sampler 60 and analyzed within the spectrometer 62 to determine its chemical composition. This sampling and analysis is carried out after the desulfurization step 44 of process 40 relating to the post-desulfurization total steel. Oxygen content (TO) can be determined by a LECO determinator and the inclusion composition (IC) can be determined by an electron microprobe analyzer. This information (total oxygen content, TO, and inclusion composition, IC) is input to computer 92 via any conventional means, such as via keyboard 100, at step 146.

The total oxygen is the total of the combined oxygen and the free oxygen in the steel.

The total oxygen content can be measured by conventional procedures using the LECO TC-436 Nitrogen/Oxygen Determinator described in the TC 436 Nitrogen/Oxygen Determinator Instructional Manual available from LECO (Form No. 200–403, Rev. April 96, Section 7 at pp. 7–1–to 7.4).

The electron microprobe analyzer used may be the EX-50 EPMA available from CAMERCA, and described in the Operations Manual User's Guide (156/06/88) and the Operations Manual Reference Guide (157/06/88) available from CAMERCA. The Electron microprobe analyzer is also generally described in "Quantitative Electro-probe Microanalysis" by V. D. Scott and G Love, Halsted Press (1983).

Thereafter at step 148, the post-desulfurization free oxygen content (FO) of the molten steel 24 within the ladle 18 is input into computer 92 via keyboard 100 or other input mechanism. The free oxygen content, FO, of the molten steel is measured by $T/O_2$ probe 66 and displayed on read out 68. Following step 148, algorithm 140 advances to step 150 where the ladle weight (LW) is input into computer 92 via keyboard 100 or other input mechanism, wherein LW is as described hereinabove with respect to step 124 of algorithm 110 adjusted by the weight of flux added at the desulfurization step and any other inclusions. Thereafter at step 152, the diameter (d) of the oxygen injection lance 72 is entered into computer 92, and at step 154 the oxygen injection pressure (P) is entered into computer 92, via keyboard 100 or other input mechanism. Following step 154, algorithm 140 advances to step 156 where the desired final free oxygen quantity (TFO) is entered into computer 92 via keyboard 100 or other input mechanism. The desired final free oxygen quantity (TFO) is generally determined through experience with, and knowledge of, the continuous strip casting apparatus/process 16, and those skilled in the art will recognize that TFO will generally vary depending upon the process parameters of the steel strip caster and of the composition of the steel strip being produced. In any case, algorithm 140 advances from step 156 to step 158 where computer 92 is operable to compute an oxygen injection time (OIT), corresponding to an amount of time oxygen is injected from oxygen source 74, through lance 72, and into the molten steel 24 within the ladle 18, as a function of TO, IC, FO, LW, d, P, and TFO.

From known mass balance equations, the quantity of oxygen ($V1_{oxygen}$) required to increase the free oxygen content in steel is given by the equation:

$$V1_{oxygen} = LW * \Delta O \quad (4),$$

where LW is the ladle weight and ΔO is the oxygen differential required to increase the free oxygen in steel from the measured free oxygen content (FO) to the desired free oxygen content TFO.

Using the strip caster, an empirical equation has been developed in accordance with the present invention to determine the desired inclusion composition; e.g., the percentages of MnO (TmnO) and $SiO_2$ (TSiO2) needed to be produced from the oxygen injection to reduce the pre-existing CaO, MgO and $Al_2O_3$ rich inclusions in the steel prior to oxygen injection. This equation is empirically developed for the particular apparatus and process:

$$\text{TMnO, TSiO2} = f(\text{composition } (\%\ \text{CaO}, \%\ \text{Al}_2\text{O}_3, \%\ \text{SiO}_2, \%\ \text{MnO}, \%\ \text{MgO}), \text{IC}) \quad (5),$$

where % CaO, % $Al_2O_3$, % $SiO_2$, % MnO, % MgO and IC are each determined via spectral analysis at step 144, and wherein IC represents the quantity (e.g., by mass or weight) of the inclusions. From this equation the final target amounts of MnO and $SiO_2$ inclusions to be generated are determined.

The quantity of oxygen required to produce TMnO and TSiO2, from known mass balance equations, is then given by:

$$V2_{oxygen} = f(\text{TMnO, TSiO2}) \quad (6),$$

and the total quantity of oxygen, $VTOT_{oxygen}$, to be injected into the ladle 18 of molten steel 24 to achieve the desired free oxygen content TFO is the sum of equations (4) and (6) and is given by:

$$VTOT_{oxygen} = V1_{oxygen} + V2_{oxygen} \quad (7),$$

where $VTOT_{oxygen}$ is therefore generally given as the function:

$$VTOT_{oxygen} = f(TO, IC, FO, LW, TFO) \quad (8).$$

The total injection time of oxygen (OIT) from source 74 through lance 72 is then given by the equation:

$$OIT=f(VTOT_{oxygen}, d, P) \quad (9),$$

where known relationships between oxygen quantity, injection pressure and injection orifice diameter may be used to determine OIT in accordance with equation (9).

Returning again to FIG. 7, algorithm 140 advances from step 158 to step 160 where computer 92 is operable to display the total oxygen injection time (OIT) on the monitor 104. An operator may then inject oxygen into the ladle 18 of molten steel 24 via lance 72 according to the displayed time period to thereby achieve the desired free oxygen content of the molten steel 24.

Figure 8:
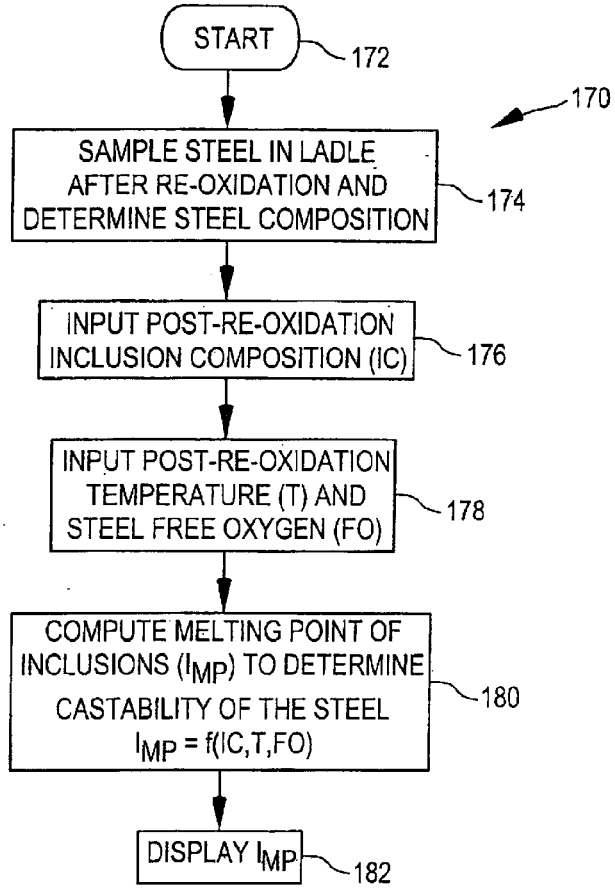
FIG. 8 is a flowchart illustrating one preferred embodiment of a software algorithm for carrying out the steel inclusion melting point temperature determination process illustrated in FIG. 3.

Referring now to FIG. 8, a flowchart is shown illustrating one preferred embodiment of a software algorithm 170 for determining the melting point of inclusions within the ladle 18 of refined steel in accordance with step 48 of process 40 of FIG. 3, in accordance with the present invention. Algorithm 170 may be stored within memory 94 of computer 92, and is executed by computer 92 to compute the inclusion melting point in accordance with step 48 of process 40. Algorithm 170 begins at step 172, and at step 174, a sample of the molten steel 24 within ladle 18 is taken via sampler 60 and analyzed within the spectrometer 62 to determine its chemical composition. This composition information is input to computer 92 via any conventional means, such as via keyboard 100 at step 176.

Thereafter at step 178, the post-reoxidation molten steel temperature, T, and steel free oxygen, FO, content are input into computer 92 via keyboard 100 or other input mechanism. In one embodiment, the temperature and free oxygen content of the molten steel 24 within the ladle 18 are measured using the temperature/oxygen probe 66 illustrated in FIG. 4, and displayed on read out 68. In this embodiment, an operator enters the temperature and free oxygen values into computer 92 based on the information on read out 68. Following step 178, algorithm 170 advances to step 180 where computer 92 is operable to compute the melting point of inclusions within the molten steel 24, $I_{MP}$, wherein $I_{MP}$ is generally a function of steel composition, T and FO.

In a silicon-killed batch of molten steel, the actual deoxidation reaction in the ladle 18 is given by the known equation:

$$Mn+Si+3O+Al_2O_3 \rightarrow (Al2O3)MnOSiO_2 \quad (10).$$

The oxygen content prior to addition of aluminum in the ladle 18 is given by a known equilibrium thermodynamic equation of the form:

$$O_{MnSi}=1/f_o[1/(f_{Mn}[\%\ Mn]f_{Si}[\%\ Si]Keq)]^{1/3} \quad (11),$$

wherein Keq is proportional to 1/T (the temperature of the molten steel determined at step 178), $f_{Mn}$ is the activity coefficient of manganese, and $f_{Si}$ is the activity coefficient of silicon. Aluminum is added as part of the deoxidation process (step 42 of process 40) so that the activity of $MnOSiO_2$ is diluted and not unity, and the oxygen content of the molten steel 24 within the ladle 18 after aluminum addition is given by a known equilibrium thermodynamic equation of the form:

$$O_{meas}=1/f_o[a_{MnOSiO2}/(f_{Mn}[\%\ Mn])f_{Si}[\%\ Si]Keq)]^{1/3} \quad (12),$$

wherein $a_{MnOSiO2}$ is the activity of $MnOSiO_2$. Dividing equation (12) by equation (11) yields:

$$O_{meas}/O_{MnSi}=[a_{MnOSiO2}]^{1/3}=f(\%\ Al_2O_3) \quad (13),$$

such that:

$$\%\ Al_2O_3=f(O_{meas}/O_{MnSi}) \quad (14).$$

Through experimentation, a function has been developed based on known equation (16) that estimates with a high degree of accuracy the percentage of aluminum oxide in the molten steel 24 within the ladle 18. That function is based on measurable quantities, namely $O_{meas}$ and $O_{MnSi}$, and is given by:

$$\%\ Al_2O_3=1.036(O_{meas}/O_{MnSi})^{4.6416} \quad (15).$$

Also the inclusion melting temperature or melting point, $I_{MP}$, has been determined from phase diagrams to follow, in one embodiment, the relationship:

$$I_{MP}=625.84(\%\ Al_2O_3)^{0.2568} \quad (16).$$

Those skilled in the art will recognize that the numerical quantities set forth in equations (15) and (16) are illustrative of one steel composition suited for use with a continuous steel strip casting apparatus/process 16, and that such numerical quantities may therefore change as a function of steel composition. Such adaptations of equations (15) and (16) to suit any such alternative steel composition are intended to fall within the scope of, but not limited to, the present invention.

In one embodiment of algorithm 170, % Mn and % Si are determined as part of the inclusion composition analysis carried out at step 174, the molten steel temperature is measured at step 178, and computer 92 then calculates $O_{MnSi}$ according to equation (11) as a function of % Mn, % Si and T. $O_{meas}$ is the free oxygen content, FO, of the molten steel 24 measured at step 178, and computer 92 is operable to compute % $Al_2O_3$ as a function of the now known $O_{meas}$ and $O_{MnSi}$ values according to equation (15). Thereafter, computer 92 is operable to compute the inclusion melting point, $I_{MP}$, as a function of % $Al_2O_3$ according to equation (16).

Figure 9:
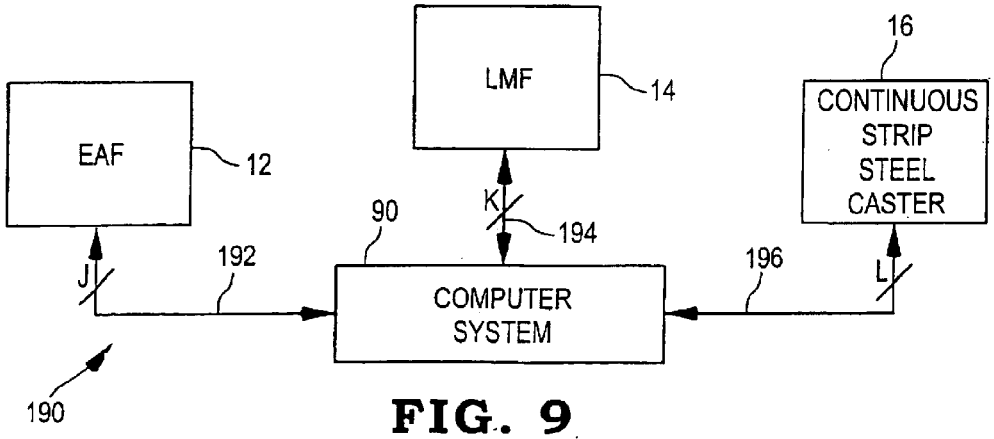
FIG. 9 is a diagrammatic illustration of another embodiment of a steel fabrication, refinement and casting process.

Referring now to FIG. 9, an alternate embodiment 190 of the steel production, refinement and casting process illustrated in FIG. 1 is shown. Embodiment 190 includes the computer system 90 of FIG. 5 electrically connected to the electric arc furnace (EAF) 12 of FIGS. 1 and 2 via a number, J, of signal paths 192 wherein J may be any positive integer. Similarly, computer system 90 is electrically connected to the ladle metallurgical furnace (LMF) 14 of FIGS. 1 and 4 via a number, K, of signal paths 194 wherein K may be any positive integer. Computer system 90 is further electrically connected to the continuous strip steel casting apparatus/process 16 of FIG. 1 via a number, L, of signal paths wherein L may be any positive integer. In the embodiment 190 illustrated in FIG. 9, computer system 90 is configured to automatically control one or more systems and/or processes associated with each of the EAF 12, LMF 14 and apparatus/process 16. In this embodiment, many of the process parameters described hereinabove that require manual entry thereof into computer 92 may be automatically entered into computer 92 in the automated system 190 illustrated in FIG. 9. Moreover, one or more of the process parameters computed by computer 92 as described herein may be automatically implemented with the automated system 190 rather than manually carried out by an operator as described above. For example, in the reoxidation step 46 of process 40, computer 92 may be configured to not only determine the total quantity of oxygen to be injected into the ladle 18 of molten steel 24, but may also be configured to automatically control the oxygen source 74 to accurately inject this quantity. Furthermore, in this embodiment, computer 92 may be configured to automate process 40 of FIG. 3 in a manner that facilitates each of steps 42-48 and controllably routes the ladle 18 to an appropriate location in the process.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A method of determining melting temperature of inclusions within a batch of molten steel, the method comprising the steps of:

determining steel composition of said batch of molten steel;

measuring temperature of said batch of molten steel;

measuring free oxygen content of said batch of molten steel; and computing melting temperature of inclusions within said batch of steel as a function of said steel composition, said temperature and said free oxygen content.

2. The method of claim 1 wherein the step of determining inclusion composition includes the steps of:

obtaining a sample of said batch of molten steel; and analyzing said sample to determine steel composition thereof.

3. The method of claim 2 wherein the analyzing step includes analyzing said sample in a spectrometer to determine steel composition thereof.

4. The method of claim 1 wherein said steel composition includes percentages of manganese and silicon within said batch of molten steel.

5. A system for determining melting temperature of inclusions within a batch of molten steel, the system comprising:

means for determining steel composition of said batch of molten steel;

a temperature sensor producing a temperature value indicative of temperature of said batch of molten steel;

an oxygen sensor producing an oxygen value indicative of free oxygen content of said batch of molten steel; and a computer configured to determine melting temperature of inclusions within said batch of steel as a function of said steel composition, said temperature value and said oxygen value.

6. The system of claim 5 wherein said device capable of determining steel composition includes a spectrometer operable to determine steel composition of a sample of said batch of molten steel.

7. The system of claim 5 wherein said temperature sensor and said oxygen sensor are included within a single probe configured for immersion into said batch of molten steel.

8. The system of claim 5 wherein said computer is configured to determine the melting point of the inclusions as a function of percentages of Mn and Si within said batch of molten steel.

* * * * *

UNITED STATES PATENT AND TRADEMARK OFFICE

CERTIFICATE OF CORRECTION

PATENT NO. : 6,921,425 B2
APPLICATION NO. : 10/886720
DATED : July 26, 2005
INVENTOR(S) : Walter N. Blejde et al.

It is certified that error appears in the above-identified patent and that said Letters Patent is hereby corrected as shown below:

On title page, item 75 Inventors
add --Rama Mahapatra, Indianapolis, IN (AU); Scott Story, Pittsburgh, PA (US); Dave Sosinsky, Whitestown, IN (US)--.

Signed and Sealed this

Seventh Day of November, 2006

JON W. DUDAS
*Director of the United States Patent and Trademark Office*